US007966931B2

(12) United States Patent
Henn et al.

(10) Patent No.: US 7,966,931 B2
(45) Date of Patent: Jun. 28, 2011

(54) SHEET-FED OFFSET PRINTING PRESS AND METHOD OF TWO-SIDED MULTI-COLOR PRINTING

(75) Inventors: Andreas Henn, Neckargemünd (DE); Jürgen Rautert, Heidelberg (DE); Norbert Rodi, Bad Schönborn (DE); Joachim Sonnenschein, Mühltal (DE); Uwe Tessmann, Schwetzingen (DE); Peter Hachmann, Dossenheim (DE); Albert Maul, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 901 days.

(21) Appl. No.: 11/879,698

(22) Filed: Jul. 18, 2007

(65) Prior Publication Data

US 2008/0017056 A1 Jan. 24, 2008

(30) Foreign Application Priority Data

Jul. 18, 2006 (DE) ..... 10 2006 033 105

(51) Int. Cl.

| | |
|---|---|
| ***B41F 23/00*** | (2006.01) |
| ***B41F 23/04*** | (2006.01) |
| ***B41F 23/08*** | (2006.01) |
| ***B41F 5/18*** | (2006.01) |
| ***B05C 11/00*** | (2006.01) |
| ***B05C 1/08*** | (2006.01) |

(52) U.S. Cl. ..... 101/177; 101/174; 101/211; 101/183; 101/424.1; 118/46; 118/66; 118/223; 118/226; 118/236; 118/255

(58) Field of Classification Search ..... 101/174, 101/177, 211, 424.1; 118/46, 223, 66, 620, 118/641–643, 226, 236, 255; 427/211, 428.01, 427/428.08–428.09, 428.11–428.12
See application file for complete search history.

(56) References Cited

U.S. PATENT DOCUMENTS

| | | | | |
|---|---|---|---|---|
| 3,384,011 | A * | 5/1968 | Bolza-Schunemann | 101/177 |
| 5,868,071 | A * | 2/1999 | Niemiro et al. | 101/218 |
| 5,873,309 | A * | 2/1999 | Mack et al. | 101/424.1 |
| 6,143,074 | A | 11/2000 | Komori | 118/209 |
| 6,338,299 | B1 | 1/2002 | Kamoda et al. | 101/424.1 |
| 6,612,234 | B2 * | 9/2003 | Hess | 101/216 |
| 6,772,709 | B2 | 8/2004 | Shibata | 118/46 |
| 6,899,029 | B2 * | 5/2005 | Invernizzi | 101/376 |
| 2002/0183479 | A1 * | 12/2002 | Rulkens et al. | 528/310 |
| 2005/0126411 | A1 * | 6/2005 | Forch et al. | 101/408 |

FOREIGN PATENT DOCUMENTS

| | | | |
|---|---|---|---|
| DE | 42 13 024 | A1 | 10/1993 |
| DE | 296 23 064 | U1 | 10/1997 |
| DE | 698 02 993 | T2 | 4/2002 |
| DE | 20303901 | * | 5/2003 |
| DE | 10 2004 058 596 | A1 | 7/2005 |
| EP | 0 976 555 | A1 | 2/2000 |

* cited by examiner

*Primary Examiner* — Leslie J Evanisko
*Assistant Examiner* — Marissa L Ferguson-Samreth
(74) *Attorney, Agent, or Firm* — Laurence A. Greenberg; Werner H. Stemer; Ralph E. Locher

(57) ABSTRACT

A sheet-fed offset printing press prints multiple colors on both sides of sheets, preferably on sheets of paper. A first row of in-line printing units print a first side of the sheet, before the sheets are turned in a reversing device, which is followed by a second row of in-line printing units for printing the other side of the sheets. The second row of in-line printing units is followed by one or more varnishing units that are arranged in such a way or include varnishing blanket cylinders that are arranged in such a way that the front sides and the back sides of the passing sheets are varnished.

24 Claims, 9 Drawing Sheets

SHEET-FED OFFSET PRINTING PRESS AND METHOD OF TWO-SIDED MULTI-COLOR PRINTING

CROSS-REFERENCE TO RELATED APPLICATION

This application claims the priority, under 35 U.S.C. §119, of German application DE 10 2006 033 105.2, filed Jul. 18, 2006; the prior application is herewith incorporated by reference in its entirety.

BACKGROUND OF THE INVENTION

Field of the Invention

The invention lies in the printing technology field. More specifically, the invention relates to a sheet-fed offset printing press for double-sided multicolor printing, preferably on sheets of paper. The press comprises a first row of printing units arranged directly in line to print on the first side of the sheet, followed by a reversing device, which is in turn followed by a second row of printing units arranged in line to print on the other side of the sheet. These are followed, finally, by one or more varnishing units. In-line printing presses of this type, which include one or more varnishing units provided at the end of the press for varnishing the sheet side that was printed last, are known and are available from a number of manufacturers.

Commonly assigned German published patent application DE 42 13 024 A1 proposes varnishing both sides of the printed sheets in one machine run, i.e. in line, in presses of the type indicated above. For this purpose, a varnishing unit and a dryer are provided in the printing press upstream of the reversing device. Thus the first side of the sheet is varnished and dried before the sheet is reversed and printed on the second side.

In this press, the first side of the sheet is varnished before the sheet passes the printing nips of the perfecting units. Consequently, the shine effect created on the sheet surface as a result of the varnishing operation is reduced: the more perfecting units or printing nips are present, the less shine remains. In addition, problems occur in particular when the varnish applied to the first side of the sheet has not dried completely in the drying device. In this case, the surfaces of the impression cylinders in the perfecting unit, which are optimized for contact with oil-based offset printing units, may get soiled by residual varnish, mixed with paper dust etc., which means that they will have to be cleaned in a time-consuming process.

In another type of printing press, described in U.S. Pat. No. 6,338,299 B1 and European patent EP 0 976 555, for example, the sheet is printed with offset printing inks alternatingly by printing units that are arranged above and below the path of paper travel. Subsequently, the sheet is varnished on both sides by varnishing units arranged above and below the path of paper travel, respectively. Apart from the fact that this type of printing press is not very common because access to the printing units below the path of paper travel is difficult, these presses have the following problem: when the last color is printed onto the second side, the sheet has already passed all printing nips. In comparison with a press that prints first on one side and then on the other side completely, the printed image is widened to a greater extent (fan-out effect) because the sheet passes through twice the number of printing nips, and it is impossible to compensate for this effect by register adjustment.

In addition to in-line varnishing units, there are separate, stand-alone varnishing devices known in the art to varnish both sides of printed sheets. A disadvantage of stand-alone varnishing devices is, however, that the sheets must first be formed into a pile and then be fed to the varnishing device individually. When they are fed to the varnishing device, the sheets, coming from the delivery pile of the printing press, have already been powdered, a fact which may be detrimental to the shine effect created by the varnishing operation and may otherwise cause difficulties. In addition, stand-alone varnishing devices require more space and more equipment than an in-line solution because two feeders and two deliveries are necessary.

German published patent application DE 10 2004 058 596 A1 describes a device for two-sided finishing of printed products. In the device, the sheets are varnished by a coating unit arranged above the path of sheet travel and a coating unit arranged below the path of sheet travel (FIG. 5). Apart from the fact that the device described in the document prints the sheets only on one side, the two varnishing units are of different construction.

SUMMARY OF THE INVENTION

It is accordingly an object of the invention to provide a sheet-fed offset printing press which overcomes the above-mentioned disadvantages of the heretofore-known devices and methods of this general type and which enables the production of high-quality sheets that are printed and varnished on both sides in an in-line process.

With the foregoing and other objects in view there is provided, in accordance with the invention, a sheet-fed offset printing press for double-sided multi-color printing, comprising:

a first row of in-line printing units for printing on a first side of a sheet;

a downstream reversing device following the first row of in-line printing units in a sheet travel direction;

a second row of in-line printing units for printing a second side of the sheet disposed downstream of the reversing device, the second row of in-line printing units including a last printing unit;

downstream varnishing units including at least two varnishing units of a common type following the last printing unit and configured to varnish the first side and the second side of the sheet on passing by, wherein one of the varnishing units is disposed below a sheet travel path followed by the sheet; and at least two IR or hot-air dryers, said dryers including at least one dryer disposed below the sheet travel path.

Preferably, the varnishing units include varnishing blanket cylinders disposed to varnish the first side and the second side of the passing sheet, and wherein one of the varnishing blanket cylinders of one of the varnishing units is disposed below the sheet travel path.

In other words, the objects of the invention are achieved with a sheet-fed rotary printing press wherein the sheets are initially printed on one side, turned, and printed on the other side before they are varnished. The varnishing units are of the same type and are arranged above and below the path of sheet travel. In this manner, a sheet-fed printing press is created that can produce sheets that are varnished on both sides in an in-line process without the difficulties explained in the introduction hereto. A greater degree of glossiness can thus be achieved on both sides of the sheet, and the cylinder surfaces and cylinder jackets in the perfecting unit can be optimized for contact with oil-based ink without the necessity of special cleaning operations.

In accordance with an added feature of the invention, the press further comprises two sheet transport cylinders provided downstream of the last printing unit in the path of sheet travel, each of the two sheet transport cylinders associated with its own varnishing unit, a respective one of the varnishing blanket cylinders of each varnishing unit being arranged above and below the path of sheet travel, respectively.

In accordance with an added feature of the invention, at least one of the varnishing units associated with the two transport cylinders is constructed as a removable inserting unit.

In accordance with an added feature of the invention, the connecting line of the axes of two successive transport drums of the printing press is inclined in an angle of more than 30° relative to the horizontal.

In accordance with an added feature of the invention, further transport cylinders follow the transport cylinders associated with the varnishing units and wherein a dryer is associated with two of the further transport cylinders.

In accordance with an added feature of the invention, the two sheet transport cylinders associated with the varnishing units immediately follow each other.

In accordance with an added feature of the invention, a dryer unit is arranged between the two transport cylinders of the two varnishing units.

In accordance with an added feature of the invention, precisely two sheet transport drums or transfer devices are arranged between the impression cylinders of the successive varnishing units. Preferably, a dryer is assigned to at least one of the two sheet transport drums. It is also possible for one of the two sheet transport drums to be a transfer device.

In accordance with an added feature of the invention, at least two of the varnishing units are arranged in such a way that their varnishing blanket cylinders form a nip through which the sheets to be varnished on both sides are guided. In a preferred embodiment, one of the two varnishing blanket cylinders has grippers for transporting the sheets to be varnished. It is preferred that the sheets to be varnished on both sides are moved/conveyed through the nip between the two varnishing blanket cylinders by gripper bars. Preferably, the grippers on the gripper bars hold the sheets on the two side edges thereof.

In accordance with an added feature of the invention, the grippers on the gripper bars hold the sheets at the leading edges thereof and convey them through the nip between the two varnishing blanket cylinders, one or both of the varnishing blanket cylinders having an axial gap into which the grippers or gripper bars dip.

In accordance with an added feature of the invention, pairs of gripper bars are provided that include grippers for holding the sheets conveyed through the nip between the varnishing blanket cylinders at the leading and trailing edges thereof.

In accordance with an added feature of the invention, the gripper bars are part of a drum the diameter of which is a multiple of the diameter of the form cylinders of the printing units and which is open in the region of the sheet surface and includes a varnishing unit on the inside of the drum. In an embodiment of the invention, a waste sheet container associated with the multiple-diameter transport drum. It is further possible to have a dryer device associated with the multiple-diameter transport drum. In one embodiment, a dryer device that is associated with the multiple-diameter transport drum is arranged partly on the inside and partly on the outside of the drum.

In accordance with an added feature of the invention, the varnishing blankets received on the varnishing cylinders are tubular jackets or are applied to tubular jackets. In a preferred embodiment, the spacing between the two varnishing blanket cylinders is adjustable so as to accommodate jackets of different thickness. It is possible to provide the jackets as gapless sleeves or as gapped sleeves.

In accordance with an added feature of the invention, the press comprises IR or hot-air dryer devices disposed downstream of the last varnishing unit as viewed in the direction of sheet travel for drying both sides of the sheets varnished on both sides.

In accordance with an added feature of the invention, at least one of the varnishing units is assigned a dryer unit arranged inside one of the drums transporting the sheets.

In accordance with an added feature of the invention, one or more of the varnishing units are designed to apply water-based varnish or dispersion varnish.

In accordance with an added feature of the invention, two or more of the varnishing units have a screen roller with a doctor blade. It is also possible to provide fountain roller-type varnishing units.

In accordance with again an added feature of the invention, the impression cylinder of the last printing unit is followed by the impression cylinder of the first varnishing unit.

In accordance with again another feature of the invention, the varnishing blanket cylinder of the first varnishing unit is arranged below the path of sheet travel.

With the above and other objects in view there is also provided, in accordance with the invention, a method of printing multiple colors on both sides of sheets, preferably sheets of paper. The novel method comprises the following steps:

feeding sheets in a sheet pile individually to a number of in-line printing units and printing on a front side of the sheets, turning the sheets that have been printed in this way and printing multiple colors on the back side of the sheets in a number of further in-line printing units, applying one or more coats of varnish to the printed front and/or back side of the sheets by identical-type varnishing units arranged above and below the path of sheet travel and drying the front and/or back side by IR and/or hot-air dryers arranged above and below the path of sheet travel, delivering the sheets that have been printed and varnished on both sides to a pile or for further processing the sheets.

In accordance with a further feature of the invention, the method includes a step of drying the sheet side that has been varnished first before varnishing the second side of the sheets. Alternatively, or in addition, the two sides of the sheets are dried after having varnished both sides.

In accordance with a concomitant feature of the invention, the drying step comprises applying radiation and/or hot air to the sheet side that faces the transport cylinder in a concave shape.

In accordance with yet a further feature of the invention, during the drying step, a dryer device arranged below the path of sheet travel applies radiation and/or hot air to the sheet side that convexly faces away from the transport cylinder.

Preferably, the printed front sides of the sheets are varnished first before the back sides of the sheets are varnished.

Other features which are considered as characteristic for the invention are set forth in the appended claims.

Although the invention is illustrated and described herein as embodied in sheet-fed offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
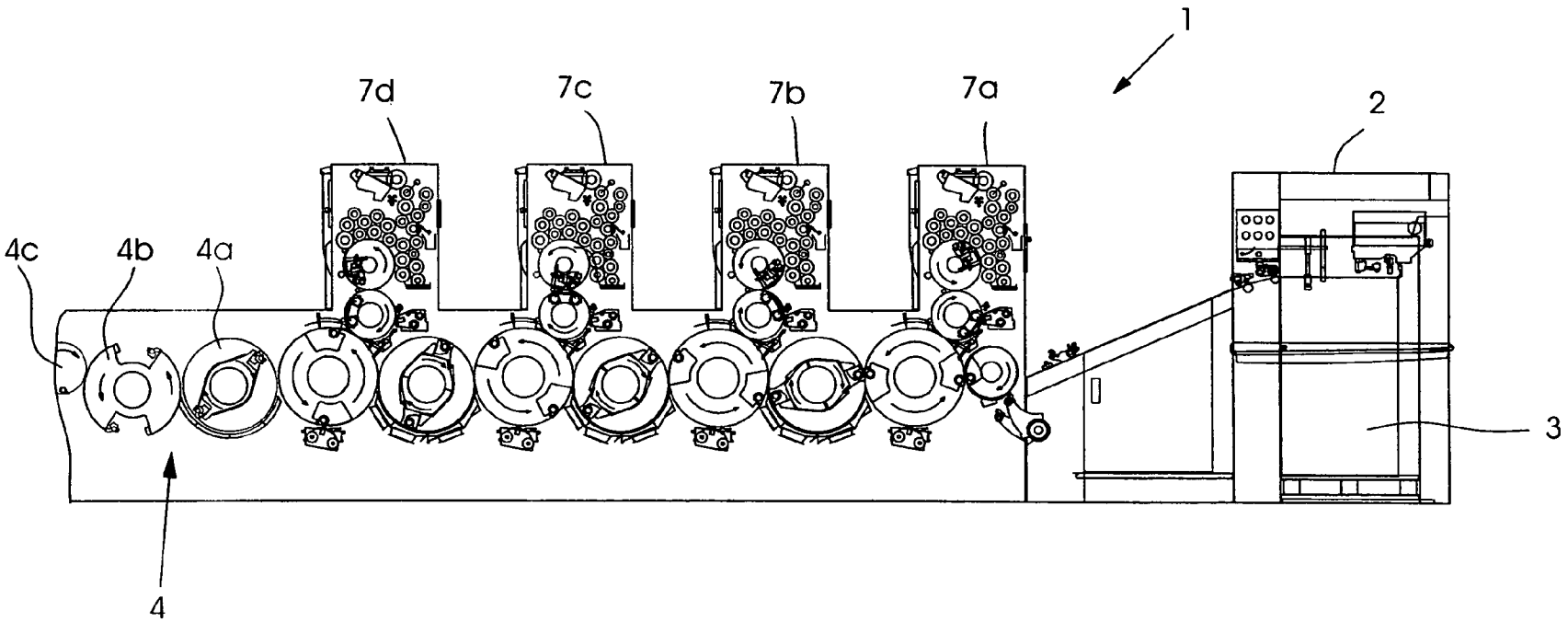
FIG. 1A shows a diagrammatic representation of the straight-printing portion in an in-line sheet-fed offset printing press.
Figure 1B:
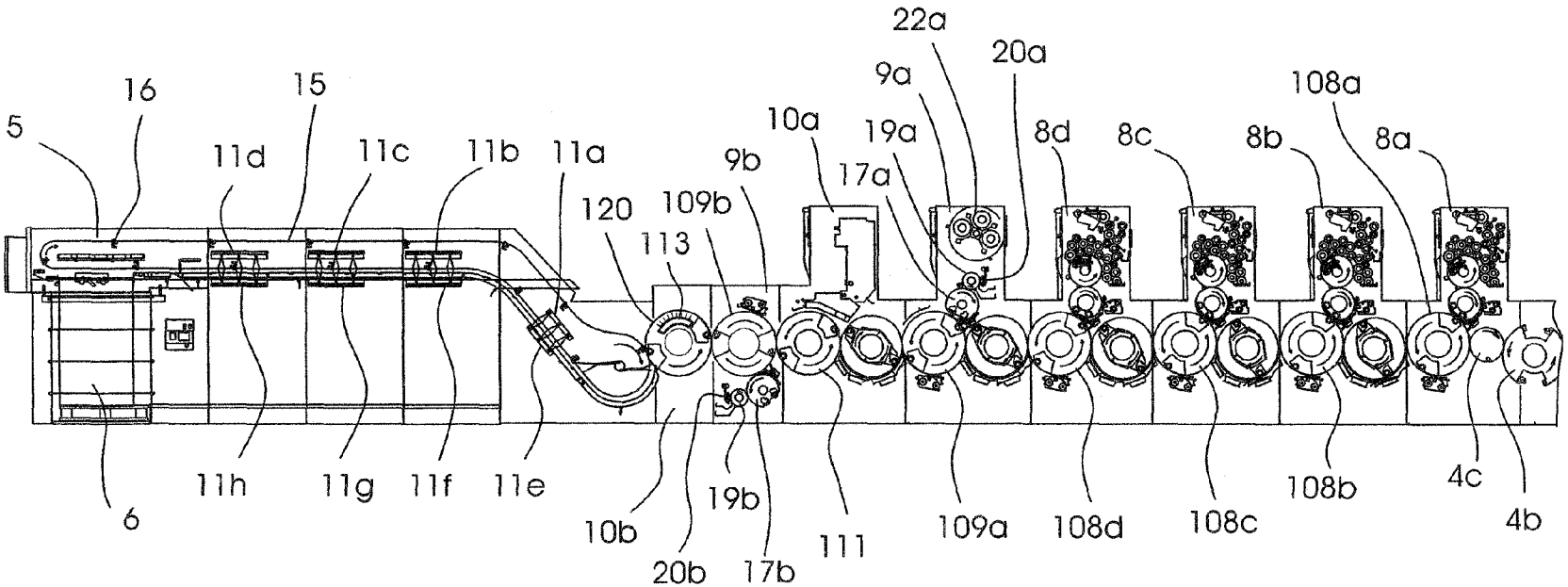
FIG. 1B shows a diagrammatic representation of the perfecting portion in an in-line sheet-fed offset printing press.

Referring now to the figures of the drawing in detail, FIG. 1A shows an offset printing press 1 of in-line construction, including a feeder 2 that holds a pile 3 of unprinted paper and four printing units 7*a* to 7*d* for four process colors. The four printing units 7*a* to 7*d* form the straight-printing portion of the press 1, i.e. the portion that prints the first side of the sheets. The fourth printing unit 7*d* is followed by a reversing device 4 that operates in accordance with the three-drum reversing principle. The reversing device 4 consists of a feed drum 4*a*, a storage drum 4*b*, and a reversing drum 4*c*. The drum 4*c* is supported in the side frames of a first perfecting unit 8*a* following the reversing device 4. The reversed sheet is transferred to an impression cylinder 108*a* of the first perfecting unit 8*a*. The second portion of the press is shown in FIG. 1B. The four perfecting units 8*a* to 8*d* are followed by a varnishing unit 9*a* of the chambered doctor-blade type, i.e. the varnishing unit 9*a* includes a screen cell roller 19*a* and a chambered doctor blade 20*a* containing aqueous dispersion varnish. Reference numeral 22*a* designates what is referred to as a "screen roller star", which includes three further screen rollers with cells of different sizes. These three further screen rollers can be exchanged for the screen roller 19*a* to determine the amount of varnish to be applied. The varnish applicator cylinder 17*a* of the varnishing unit 9*a* coats the entire surface of the second side of the sheet with an aqueous dispersion varnish.

The varnishing unit 9*a* is followed by a drying tower 10*a*. In this drying tower, the second side of the passing sheet is dried in the region of the cylinder 110*a* by hot air and IR light.

Downstream of the drying tower 10*a*, as viewed in the direction of sheet travel, there is disposed a second varnishing unit 9*b* of the same type as the varnishing unit 9*a* and of substantially identical construction with the first varnishing unit 9*a* in terms of the screen roller 19*b*, varnish applicator cylinder 17*b*, and chambered doctor blade 20*b*. However, the varnish applicator cylinder 17*b* contacts the sheet transport drum 109*b*, embodied as a varnish impression cylinder, from below the path of sheet travel. The varnishing unit 9*b* is used likewise to coat the entire surface of the first side of the sheet with an aqueous dispersion varnish.

The varnishing unit 9*b* is followed by a second dryer 10*b*, which dries the varnished first side of the sheets with IR light and/or hot air. This dryer 10*b* includes an IR light emitter 113, which is arranged inside the sheet transport drum 120 and is consequently located below the path of sheet travel, just as the varnishing unit 9*b*.

The dryer 10*b* is followed by the delivery 5, 105 of the printing press. The delivery 5, 105 includes revolving gripper bars driven by a chain conveyor 15, 115. These gripper bars 16 take over the sheets that have been varnished on both sides and guide them through dryer sections 11*a-h*, where both sides of the sheets are again dried by IR light and/or hot air to harden the dispersion varnish. The sheets, which been varnished and dried on both sides in this way, are then deposited on a sheet pile 6 in the delivery 5.

While the sheets are transported through the printing units 7*a* to 7*d* and 8*a* to 8*d*, the printed sheets do not get into contact with varnish. The surfaces of the sheet-guiding impression cylinders 108*a-d* in the printing units 8*a-d* and the guide plates of the transfer devices arranged between the printing units 8*a-d* may thus be coated with ink-repellent layers that are adapted to or optimized in terms of the properties of the oil-based offset inks. The viscous dispersion varnish that causes soiling is not introduced until the end of the press, when the process of printing with offset printing ink is completed. Thus compared to configurations wherein the varnishing unit is located upstream of the first reversing device 4, the useful life of the cylinder jackets and the intervals between cleaning operations can be increased considerably.

Figure 2:
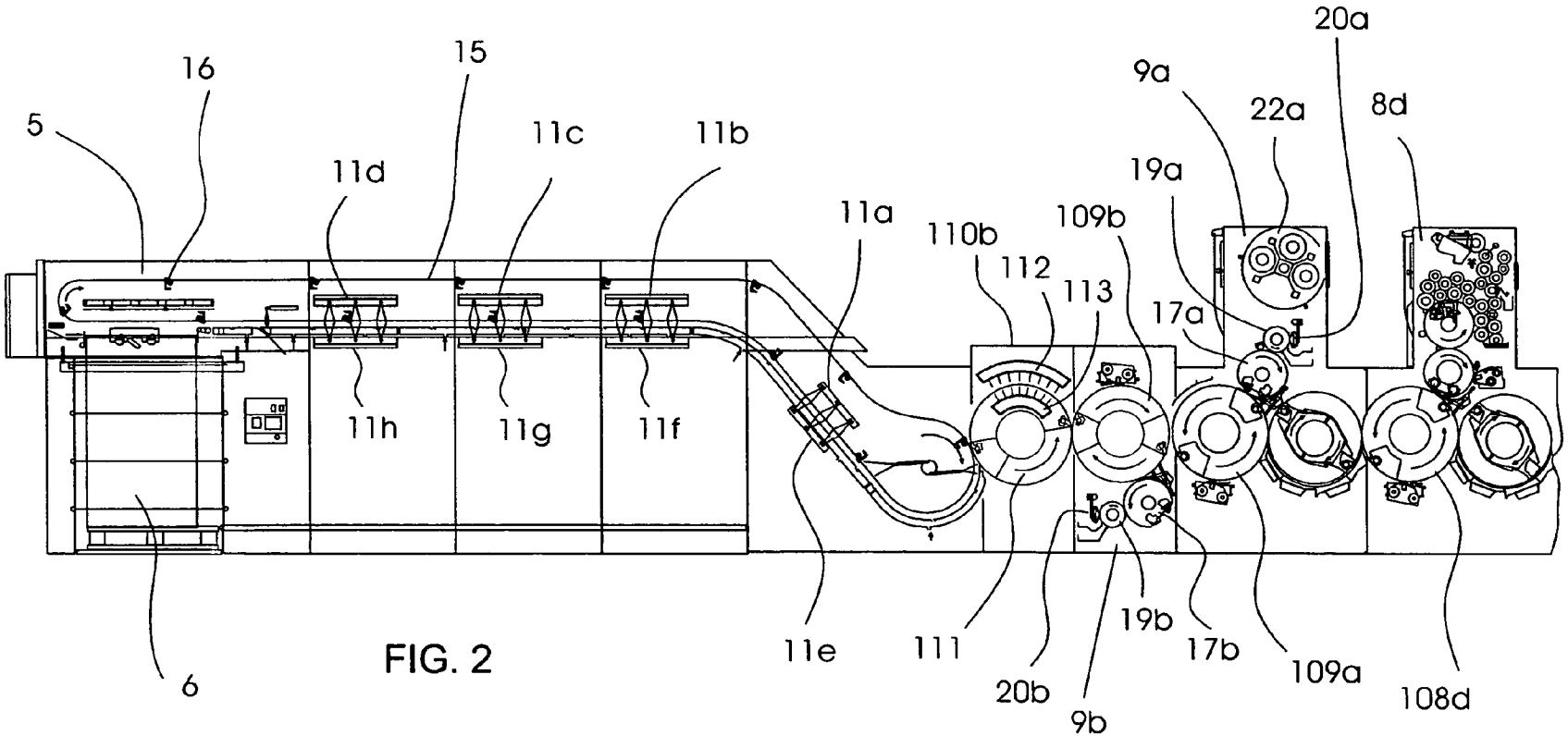
FIG. 2 shows a second exemplary embodiment of the perfecting portion of the printing press as shown in FIG. 1B.

In the exemplary embodiment shown in FIG. 2, the part following the last printing unit 8*d* of the printing press described above with reference to FIGS. 1*a* and 1*b* has been modified. Now the drying tower 10*a* of FIG. 1B has been eliminated, which means that the sheet exiting the varnishing unit 9*a* is directly fed to the second varnishing unit 9*b*. Downstream of the second varnishing unit 9*b*, wherein the first side is varnished, a dryer 110*b* is provided. This dryer includes a first IR dryer 112 arranged above the sheet transport drum 111 and a second IR dryer 113 arranged to be stationary inside the drum 111, which is built in frame construction. Then the sheet, which has been varnished on both sides, passes four dryer modules 11*a-h* in the chain delivery 5. In the dryer modules 11*a-h*, the sheet is dried on both sides, i.e. from above and from below by IR light and hot air. For this purpose, dryers 11*e* to *h*, which are integrated into the sheet guiding system of the delivery 5, may be used, as described in the above-mentioned published German patent application DE 10 2005 042 956 A1.

As one transfer device and the separate drying tower downstream of the first varnishing unit 9*a* are dispensed with, the press is shorter and requires less floor space than the press described with reference to the exemplary embodiment shown in FIG. 1B.

Figure 3:
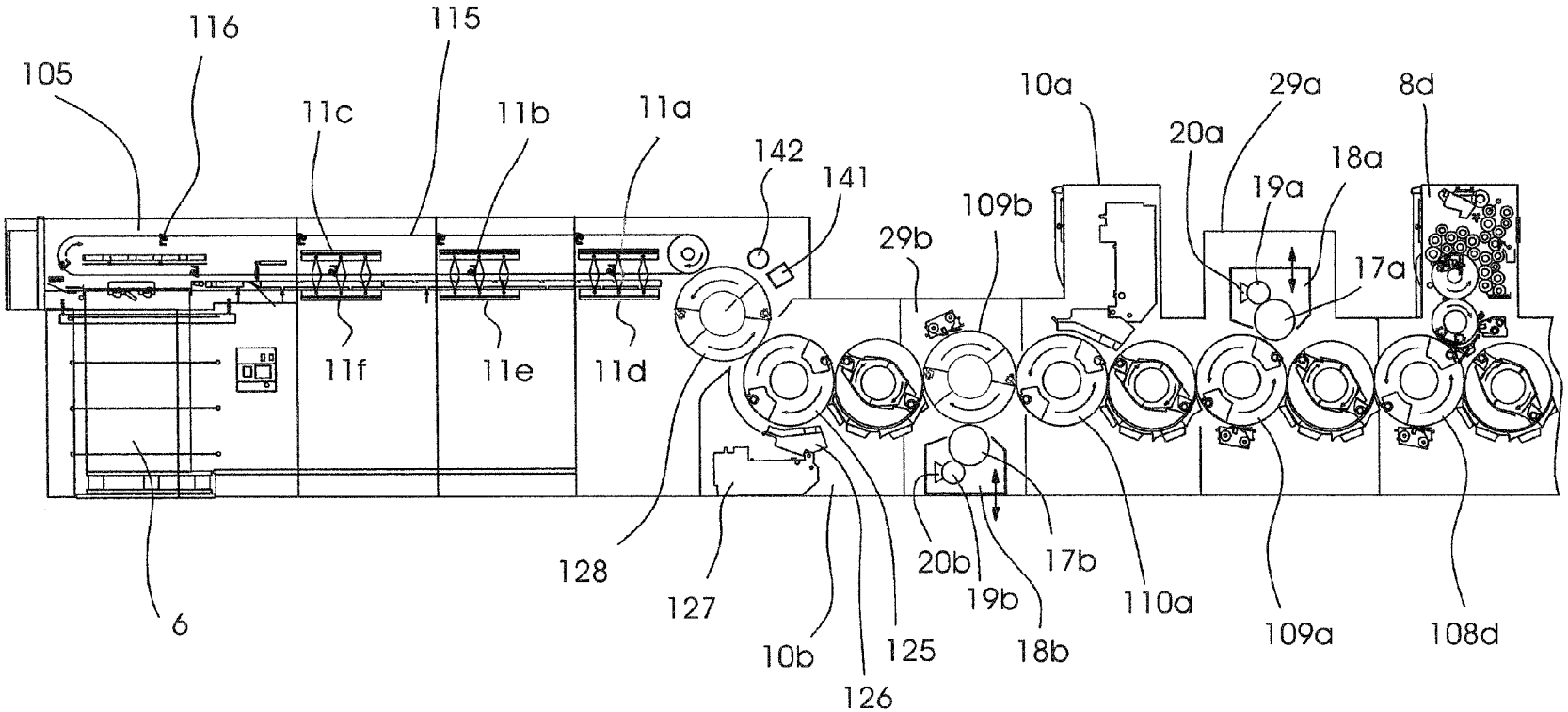
FIG. 3 shows a third exemplary embodiment of the perfecting portion of the printing press as shown in FIG. 1B.

The exemplary embodiment of FIG. 3 comprises a varnishing unit 29*a* disposed downstream of the last printing unit 8*d* of the perfecting portion of the printing press 1. This varnishing unit differs from the varnishing unit 9*a* of FIGS. 1B and 2 inasmuch as the screen roller 19*a*, the chambered doctor blade 20*a*, and the varnish applicator roller 17*a* are combined to form an exchangeable and removable unit 18*a*, which is additionally arranged in the varnishing unit 29*a* to be adjustable in height, as indicated by the arrow, for the purpose of engaging the unit with the varnish impression cylinder 109*a*.

As described above with reference to FIG. 1, the varnishing unit 29*a* is followed by a drying tower 10*a*, wherein the sheets, which have been varnished on the second side, are dried by hot air and/or IR light before the sheet is transferred to the impression cylinder of the varnishing unit 29*b* by the transport cylinder 110.

Like the varnishing unit 29*a*, the varnishing unit 29*b* comprises a removable and exchangeable unit 18*b* that includes the varnish applicator roller 17*b*, the screen roller 19*b*, and the chambered doctor blade 20*b*. However, the unit 18*b* is mirror-inverted relative to the unit 18*a* and is engaged with the impression cylinder 109*b* below the path of sheet travel to varnish the first side of the passing sheets.

The varnishing unit 29*b* is followed by a transfer device and a second dryer 10*b*. Under the sheet-guiding drum 125 of the second dryer 10*b*, an IR light source 126 and a hot-air box 127 are provided to dry the first side of the sheet before the sheet is fed to a further sheet transport drum 128. The axis of the sheet transport drum 128 is arranged considerably above the axis of the transport cylinder 125. The connecting line of the two axes of these cylinders forms an angle $\alpha>30°$ with the horizontal. Thus the transported sheets are conveyed upward to the level of the gripper bars 116 revolving horizontally on the guide chains 115, which may consequently be of relatively simple and cost-efficient structure because they need not be deflected from an inclined guide region to a horizontal guide region.

An examination camera 141 and a powdering device 142 are arranged above the side of the transport drum 128 on which the transported sheets lie. As the sheets lie on the transporting cylinder 128 in a defined position, the sheet surface can be easily examined by the camera 141 because the focusing distance is constant and is not affected by fluttering movements of the sheet to be examined. In addition, the powder emitted by the powdering device 142 can hit the sheet, which rests on the cylinder 128, at a high speed without the danger of smearing because the sheet, which has been dried in the dryer 10*a* on the second side, rests on the surface of the cylinder 128, which is ink and varnish repellent, without relative movement.

Figure 4:
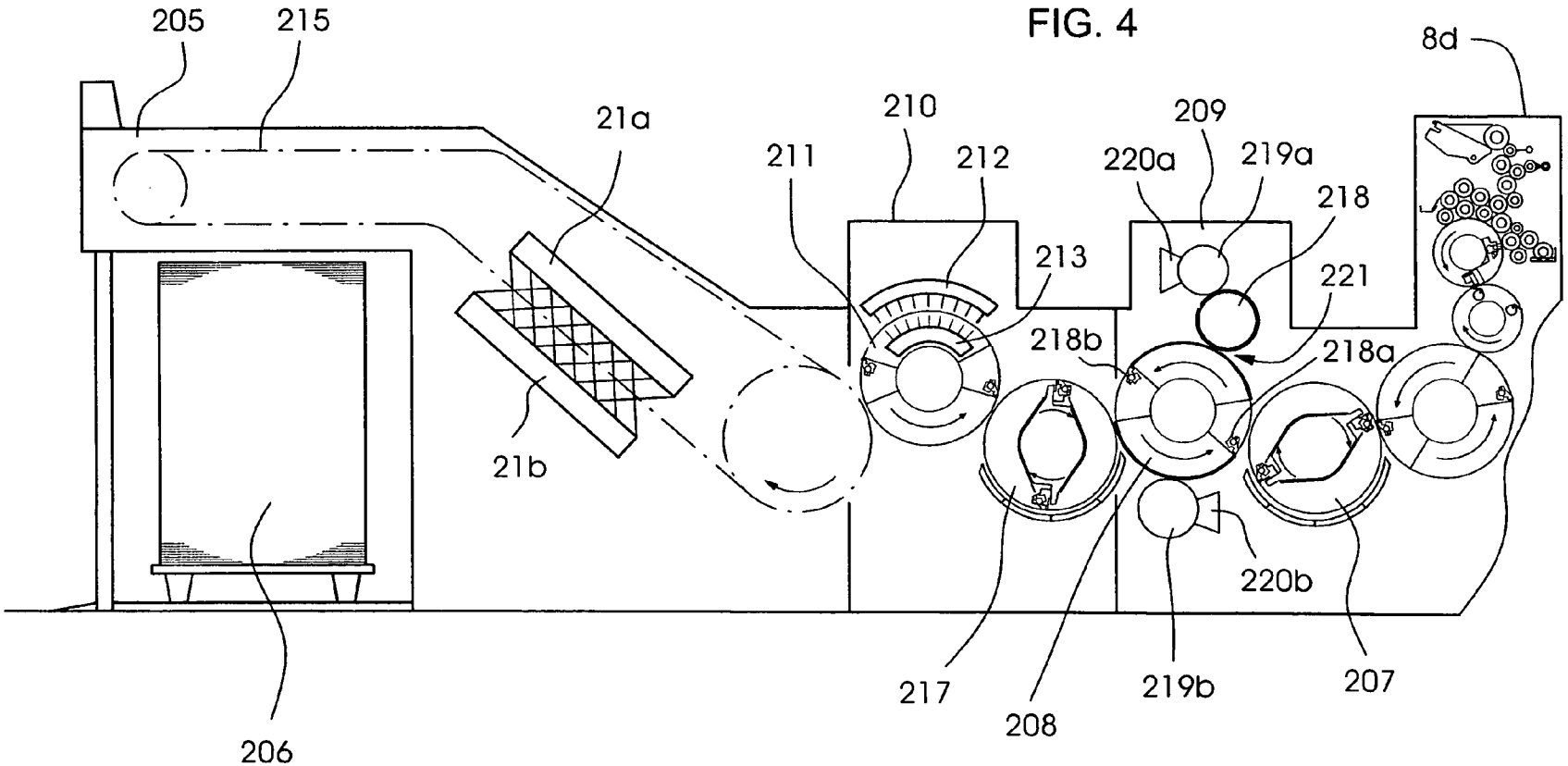
FIG. 4 shows the end of the press following the last printing unit of a fourth exemplary embodiment of the perfecting portion of the printing press as shown in FIG. 1B.

In the exemplary embodiment of FIG. 4 the last perfecting unit 8*d* is followed by a varnishing unit 209 wherein the sheets exiting the printing unit 8*d* are transferred to a double-diameter varnishing blanket cylinder 208 by a transfer device 207. This double-diameter varnishing blanket cylinder 208 carries gripper bars 218*a* and 218*b* countersunk below the radius of the varnishing blanket surface. The grippers, which are attached to the gripper bars, only protrude beyond the radius of the varnishing blanket surface to open and grip the leading edge of the sheets. As they close, they retract below this radius.

The entire surface of the second side of the sheet transported by the varnishing blanket cylinder 208 is varnished by a second varnishing blanket cylinder 218. The dispersion varnish, for example, is supplied to the varnish applicator roller 218 by a screen roller 219*a* with a chambered doctor blade. At the same time, the varnishing blankets fastened to the first varnishing blanket cylinder 208 by non-illustrated fixing devices are provided with a layer of varnish by a second screen roller 219*b* in connection with a chambered doctor blade 220*b*. The sheets held by the grippers 218*a* and 218*b*, respectively, and conveyed through the printing or rather varnishing nip 221 are then deposited on the layer of varnish.

Once the sheets have passed the varnishing nip 221 and have thus been varnished on both sides, they are taken over by a transfer device 217, which peels the sheets off the varnishing blankets on the cylinder 208 and transfers them to a dryer 210. The latter is constructed like the dryer 110*b* of FIG. 2, i.e. it includes one dryer unit 212 outside the transport drum 211 and one dryer unit 213 inside the transport drum 211, so that the two sides of the sheets, which have been varnished simultaneously, can be dried simultaneously before the sheets are transferred to the gripper bars of the chain conveyor 215 in the delivery 205. In the delivery 205 itself there are two further dryer modules 21*a* and 21*b*, which, in a manner similar to that of the dryer modules 11*a-h* in the exemplary embodiments of FIGS. 1 and 2, complete the drying process of the sheets before the latter are deposited on the pile 206.

Figure 5:
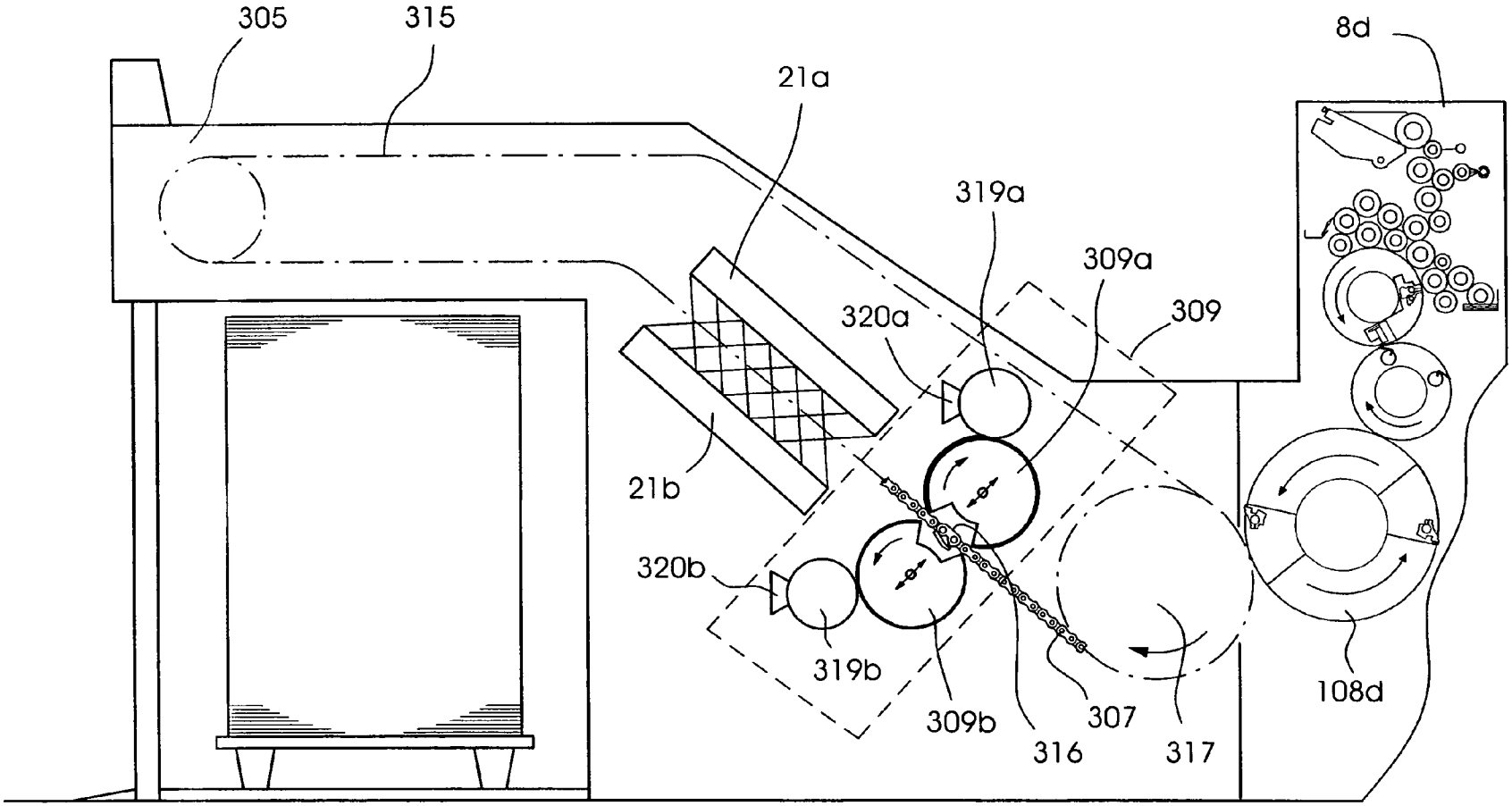
FIG. 5 shows the end of the press following the last printing unit of a fifth exemplary embodiment of the perfecting portion of the printing press as shown in FIG. 1B.

The exemplary embodiment of FIG. 5 differs from that of FIG. 4 in that the last printing unit 8*d* of the perfecting portion of the printing press 1 is directly followed by the delivery 305 with the chain conveyor 315. Thus the sheets exiting the printing unit 8*d* have yet only been printed with ink when they are taken over by the gripper bars 316 on the revolving chains 307.

On both sides of the plane that is formed by the revolving chain pairs in the delivery, a double varnishing unit 309 consisting of two varnish blanket cylinders 309*a* and 309*b* is provided. Each of the varnish blanket cylinders is coated with varnish by a respective associated screen roller 319*a* and 319*b*, respectively, in connection with chambered doctor blades 320*a* and 320*b*, respectively.

The varnish blanket cylinders 309*a* and 309*b* include gaps embodied in such a way that the gripper bars 316 can pass without touching the cylinders 309. For this purpose, the cylinders 309 are synchronized with the drives of the sprocket 317 by non-illustrated gear transmissions.

The sheets, which are passed between the varnishing blankets of the varnish blanket cylinders 309*a* and 309*b* by the gripper bars 316 and are thus varnished simultaneously on the front and back sides are then dried on both sides in dryer modules 21*a* and 21*b*, respectively, as described with reference to FIG. 4 and to the other exemplary embodiments.

Compared to the exemplary embodiment of FIG. 4, the result obtained by the exemplary embodiment of FIG. 5 is considerably improved in terms of the varnishing operation because the symmetry of the varnish applicator rollers results in the same conditions on both sides of the passing sheets.

The axes of the varnish applicator cylinders 309*a* and 309*b* may be supported in such a way that they are separable from each other as indicated by the double arrows. As a result, it is possible to embody the parts carrying the varnishing blanket as exchangeable jackets that can be replaced by jackets of different thickness and outer diameter. The jackets may also be replaced by jackets that have a particularly long gap recess so that it is possible, if desired, to varnish sheets that are held on their leading and trailing edges simultaneously by double gripper bars, that is to say that both the leading edge bar and the trailing edge bar can be accommodated in the gap of the varnishing blanket cylinders even if different formats are processed.

Figure 6:
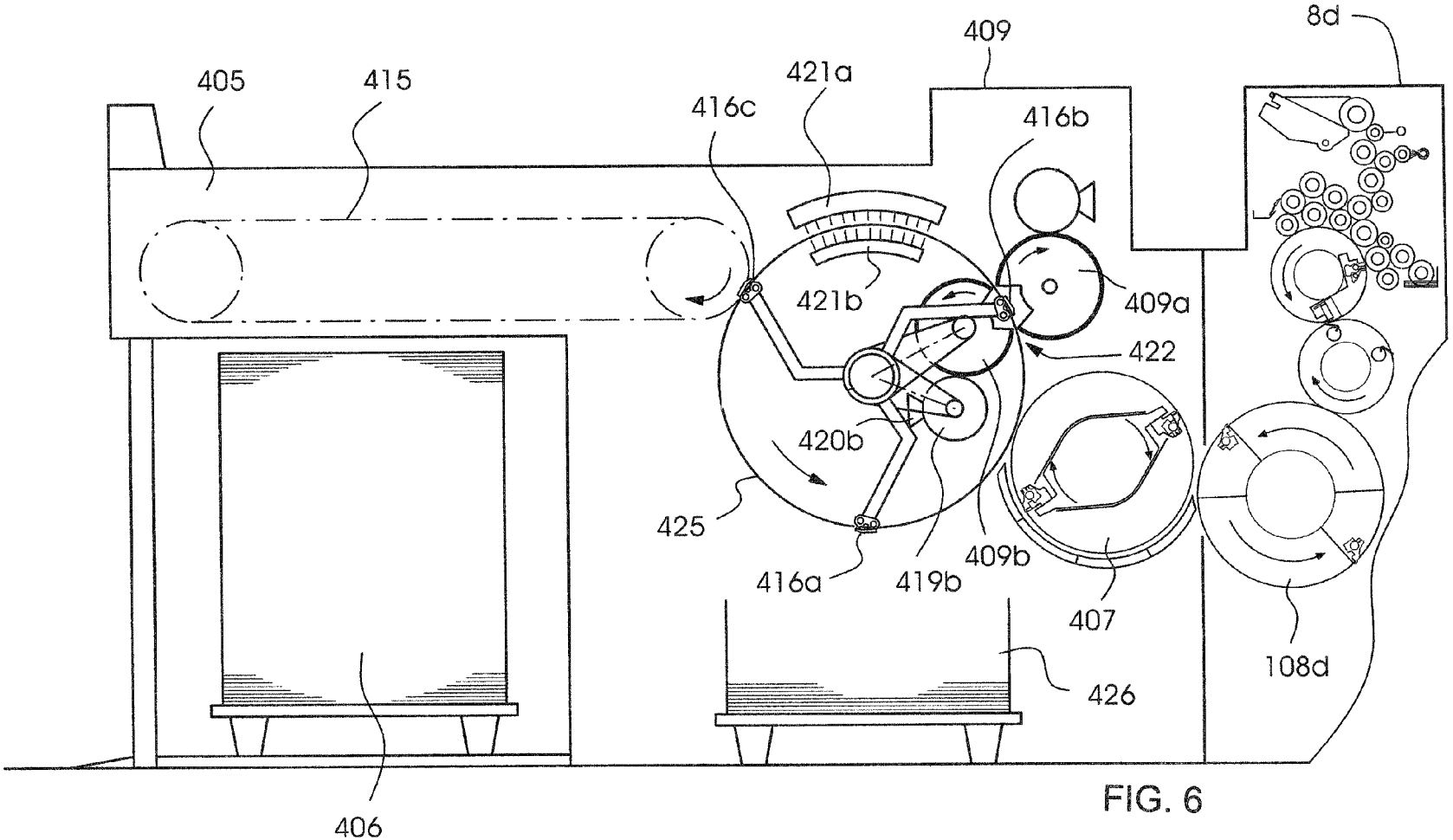
FIG. 6 shows the end of the press following the last printing unit of a sixth exemplary embodiment of the perfecting portion of the printing press as shown in FIG. 1B.

The embodiment of FIG. 6 differs from that of FIG. 5 in that the delivery 405 is equipped with a simple chain conveyor 415 that extends merely in the horizontal direction in a manner similar to that of FIG. 3. Instead of the rising portion of the chain conveyor in FIG. 4, a sheet transport drum 425 is provided that carries three gripper bars 416*a, b*, and *c* in frame construction. The sheets exiting the printing unit 8*d* are transferred to the gripper bars 416 of the drum 425 by a transfer device 407. The drum 425 conveys the sheets to the height of the chain conveyor 415 in the delivery 405 and, in a way similar to that of chain 307 in FIG. 5, through the varnishing nip 422 between the varnishing blanket cylinders 409*a* and 409*b*.

The chambered doctor blade 420*b* and the screen roller 419*b* of the second varnishing unit are located inside the drum 425, which is easily accessible from the side of the sheet pile 406. In addition, the space between the gripper bars 416 is clear, which means that the varnished sheets can be dried after the varnishing operation by combined IR and hot-air dryers 421*a* and 421*b* arranged above and below the path of paper travel.

A container 426 for waste sheets is provided underneath the drum 425. If the opening instant of the grippers on the three gripper bars 416*a-c* is suitably controlled, it is possible to transfer non-defective sheets to the chain conveyor 415 of the delivery 405, whereas defective sheets are not released until they reach the container 426. In-line examination systems provided in the path of sheet travel downstream of the last printing unit 8*d* of press 1 are suited for recognizing non-defective and defective sheets.

What has been said with reference to the varnishing blanket cylinders 309 also applies to the varnishing blanket cylinders 409, i.e. as described with reference to FIG. 5, they can be equipped with jackets of different thickness, diameter and gap length.

Figure 7:
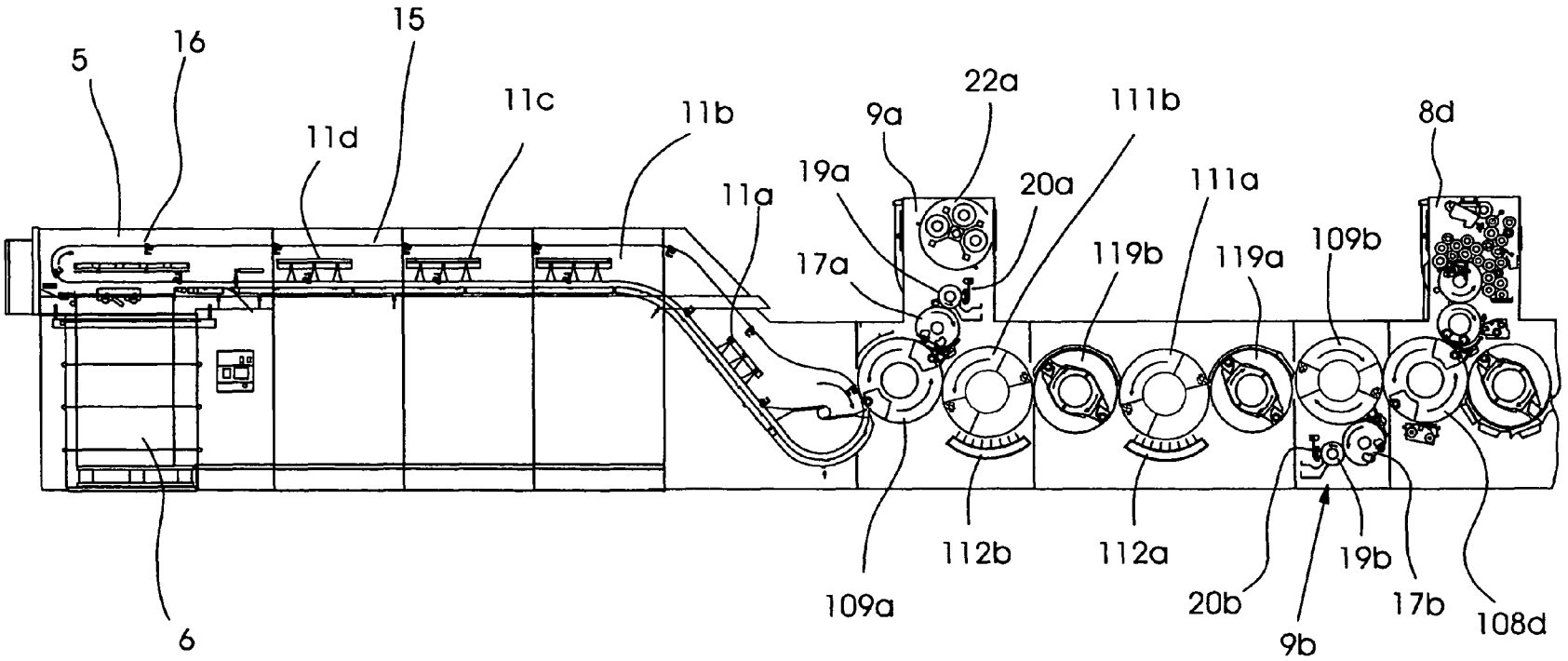
FIG. 7 shows the end of the press following the last printing unit of a seventh exemplary embodiment of the perfecting portion of the printing press as shown in FIG. 1B.
Figure 8:
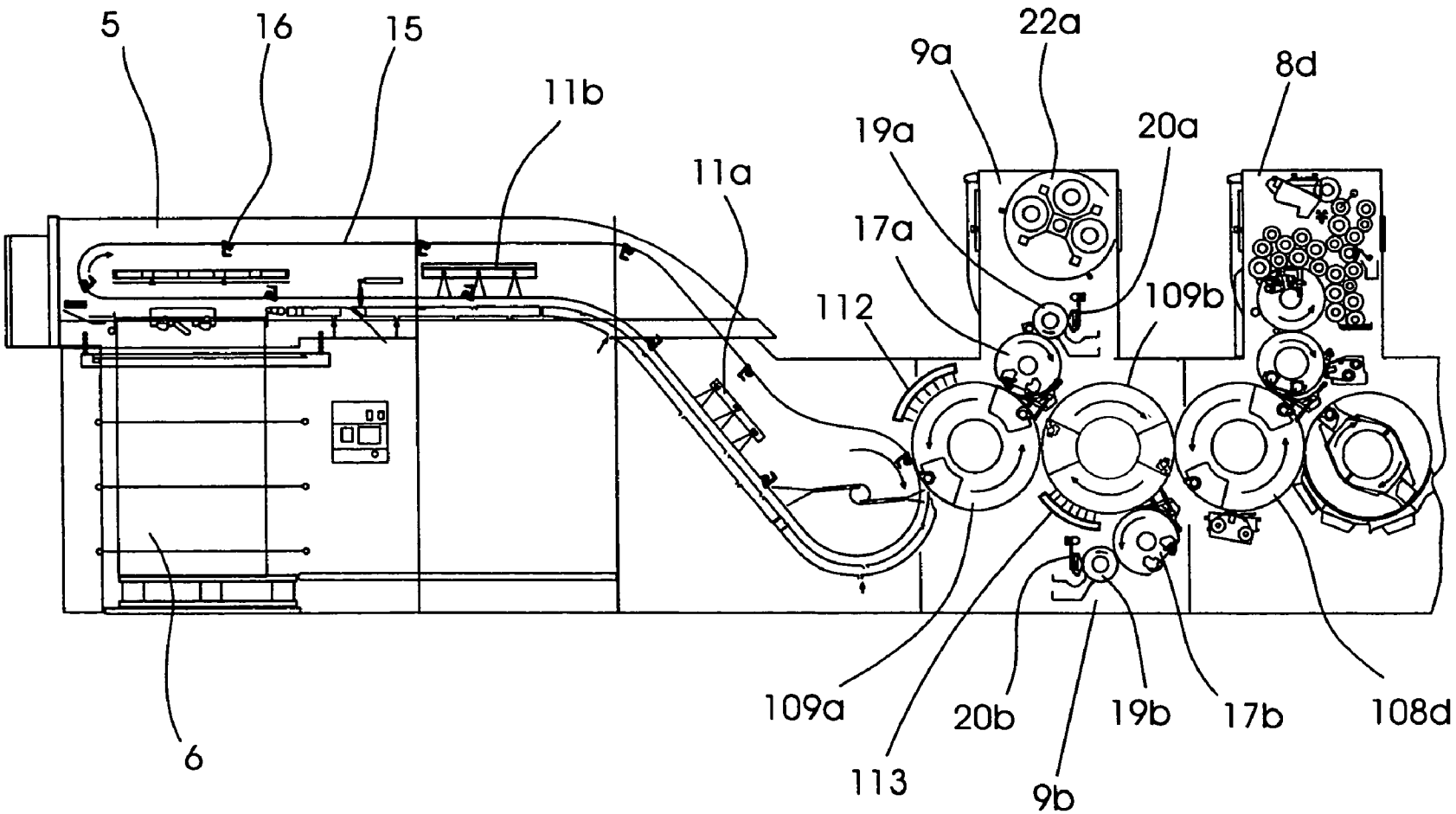
FIG. 8 shows the end of the press following the last printing unit of an eighth exemplary embodiment of the perfecting portion of the printing press as shown in FIG. 1B.

Two further exemplary embodiments of the invention, which are particularly advantageous, are represented in FIGS. 7 and 8. What they have in common is that the last printing unit 8*d* of the perfecting portion of the printing press is followed by the varnishing unit 9*b*, wherein the varnishing blanket cylinder 17*b* and the screen roller 19*b* with the chambered doctor blade 20*b* are arranged below the impression cylinder 109*b* and thus below the path of sheet travel. In the exemplary embodiment of FIG. 7, the impression cylinder 109*b* of the first varnishing unit, which varnishes the front side, i.e. the first side, of the sheet, is followed by two dryers. Each of these dryers consists of a sheet transport cylinder 111*a*, 111*b*, respectively, below which, i.e. also below the path of sheet travel, a respective dryer 112*a*, 112*b* is arranged. These dryers may be IR dryers or hot-air dryers. A transfer device 119*a* is provided between the impression cylinder 109*b* of the first varnishing unit and the transport cylinder 11*a* of the first dryer, and a second transfer device 119*b* is located between the two sheet transport cylinders 111*a* and 111*b* of the dryers. The dryers are followed by the second varnishing unit 9*a*, in which the perfecting or second side of the sheets is varnished. It should be noted that, in this exemplary embodiment, the transport cylinder 111*b* of the second dryer transfers directly to the impression cylinder 109*a* of the second, here "upright" varnishing unit.

The second varnishing unit 9*a* is followed by a delivery, as it has been described with reference to FIG. 1*b*. However, here, only the perfecting or second side of the sheet needs to be dried by dryer modules 11*a* to 11*d*, because the first side has already been dried by dryers 112*a* and 112*b*.

Compared to the exemplary embodiment shown in FIG. 7, the exemplary embodiment shown in FIG. 8 dispenses with the two transfer devices 119*a* and 119*b* as well as the two transport cylinders 111*a* and 111*b*. The impression cylinder 109*b* of the first varnishing unit 9*b*, which varnishes the front or first side of the sheets "from below", is directly followed by the impression cylinder 109*a* of the second, "upright" varnishing unit 9*a* as viewed in the direction of sheet travel. Here, intermediate level dryers 113 below the path of sheet travel and 112 above the path of sheet travel are provided to dry the sheets before they are transferred to the delivery 5. The two dryers 113 and 112 are arranged directly below and above the impressions cylinders 109*b* and 109*a* of the two varnishing units. The varnishing units also include a non-illustrated hot-air or radiation barrier to prevent heat or radiation coming from the dryer 112 or 113 from reaching the varnishing unit and heating up the components of the varnishing unit.

As varnishing is carried out from below directly after the last printing unit 8*d*, a very compact design can be implemented. The exemplary embodiment in accordance with FIG. 8 in particular minimizes the number of components that are used for varnishing both sides of the sheets. It is not necessary to dry the sheets from inside a rotating drum, so that even as far as the dryer is concerned, components that are already present can be used.

Thus by varnishing the sheets at first "from below" after the last printing unit 8*d*, advantageous configurations both in terms of the required floor space of the press and in terms of the development work and costs of the machine can be implemented.

Further modifications and variations are possible in addition to the exemplary embodiments of the invention as described above. Depending on the type of varnish that is used, varnishing units including a fountain roller may be used instead of the varnishing units with chambered doctor blade. In addition, it is possible to use additional printing units in the straight-printing and perfecting portions of the press for printing, for example, 2×2 special or spot colors, instead of only four printing units for the four process colors. The gripper bars 316, 416, which hold the leading edges of the sheets in the delivery of the printing press, may be replaced by gripper bar arrangements that hold the sheets on both of their side edges as described, for example in the commonly assigned U.S. Pat. No. 6,923,119 B1. There, the varnishing blanket cylinders 309*a, b* and 409*a, b*, respectively, do not require gaps, and if jackets are used that are applied to the varnishing blanket cylinders 409, these jackets may be seamless and have thin walls.

The invention claimed is:

1. A sheet-fed offset printing press for double-sided multicolor printing, comprising:

a first row of in-line printing units for printing on a first side of a sheet;

a downstream reversing device following said first row of in-line printing units in a sheet travel direction;

a second row of in-line printing units for printing a second side of the sheet disposed downstream of said reversing device, said second row of in-line printing units including a last printing unit;

downstream varnishing units including at least two varnishing units of a common type following said last printing unit and configured to varnish the first side and the second side of the sheet on passing by, wherein one of said varnishing units is disposed below a sheet travel path followed by the sheet, at least two of said varnishing units being disposed for defining a nip between varnishing blanket cylinders thereof, and wherein sheets to be varnished on both sides are guided through said nip; and at least two IR or hot-air dryers, said dryers including at least one dryer disposed below the sheet travel path;

gripper bars disposed for conveying sheets to be varnished on both sides through the nip between said two varnishing blanket cylinders;

a multiple-diameter transport drum having a diameter being a multiple of a diameter of a form cylinder of said printing units, said gripper bars forming a part of said drum and said drum being open in a region of a sheet surface and containing a varnishing unit inside said drum.

2. The printing press according to claim 1, which further comprises a waste sheet container associated with said multiple-diameter transport drum.

3. The printing press according to claim 1, which further comprises a dryer device associated with said multiple-diameter transport drum.

4. The printing press according to claim 3, wherein said dryer device associated with said multiple-diameter transport drum is partly disposed inside said drum and partly disposed outside said drum.

5. A sheet-fed offset printing press for double-sided multi-color printing, comprising:

a first row of in-line printing units for printing on a first side of a sheet;

a downstream reversing device following said first row of in-line printing units in a sheet travel direction;

a second row of in-line printing units for printing a second side of the sheet disposed downstream of said reversing device, said second row of in-line printing units including a last printing unit;

downstream varnishing units including at least two varnishing units of a common type following said last printing unit and configured to varnish the first side and the second side of the sheet on passing by, said varnishing units each including a respective varnishing blanket cylinder disposed for respectively varnishing the first side and the second side of the passing sheet that are varnished, said varnishing units each including a respective transport cylinder, said respective blanket cylinder and said respective transport cylinder defining a nip therebetween, one of said varnishing blanket cylinders being disposed above the sheet travel path and another of said varnishing blanket cylinders being disposed below the sheet travel path;

precisely two sheet transport drums or transfer devices being disposed between said respective transport cylinders of successive said varnishing units.

6. The printing press according to claim 5, wherein at least one of said varnishing units associated with said two transport cylinders is constructed as a removable inserting unit.

7. The printing press according to claim 5, wherein a connecting line of cylinder axes of two successive transport drums of the printing press is inclined at an angle of more than 30° relative to a horizontal.

8. The printing press according to claim 5, which comprises further transport cylinders following said transport cylinders associated with said varnishing units, and wherein said dryer is associated with two of said further transport cylinders.

9. The printing press according to claim 5, which further comprises a dryer unit disposed between said two transport cylinders of said two varnishing units.

10. The printing press according to claim 5, which comprises a dryer assigned to at least one of said two sheet transport drums.

11. The printing press according to claim 5, wherein one of said two sheet transport drums is a transfer device.

12. The printing press according to claim 5, wherein said dryer devices are IR or hot-air dryer devices disposed downstream of a last varnishing unit in the sheet travel direction for drying both sides of the sheets after varnishing on both sides.

13. The printing press according to claim 5, wherein at least one of said varnishing units is assigned a dryer unit disposed inside a sheet transport drum.

14. The printing press according to claim 5, wherein one or more of said varnishing units are configured to apply water-based varnish or dispersion varnish.

15. The printing press according to claim 5, wherein two or more of said varnishing units include a screen roller with a doctor blade.

16. The printing press according to claim 5, wherein said two varnishing units include fountain rollers.

17. A sheet-fed offset printing press for double-sided multi-color printing, comprising:

a first row of in-line printing units for printing on a first side of a sheet;

a downstream reversing device following said first row of in-line printing units in a sheet travel direction;

a second row of in-line printing units for printing a second side of the sheet disposed downstream of said reversing device, said second row of in-line printing units including a last printing unit;

downstream varnishing units including at least two varnishing units of a common type following said last printing unit and configured to varnish the first side and the second side of the sheet on passing by, wherein one of said varnishing units is disposed below a sheet travel path followed by the sheet, at least two of said varnishing units being disposed for defining a nip between varnishing blanket cylinders thereof, and wherein sheets to be varnished on both sides are guided through said nip; and at least two IR or hot-air dryers, said dryers including at least one dryer disposed below the sheet travel path;

gripper bars disposed for conveying sheets to be varnished on both sides through the nip between said two varnishing blanket cylinders, said gripper bars carrying grippers configured to hold the sheets at leading edges thereof and convey the sheets through said nip between said two varnishing blanket cylinders, and wherein both of said varnishing blanket cylinders are formed with an axial gap into which said grippers or said gripper bars dip.

18. A sheet-fed offset printing press for double-sided multi-color printing, comprising:

a first row of in-line printing units for printing on a first side of a sheet;

a downstream reversing device following said first row of in-line printing units in a sheet travel direction;

a second row of in-line printing units for printing a second side of the sheet disposed downstream of said reversing device, said second row of in-line printing units including a last printing unit;

downstream varnishing units including at least two varnishing units of a common type following said last printing unit and configured to varnish the first side and the second side of the sheet on passing by, wherein one of said varnishing units is disposed below a sheet travel path followed by the sheet, at least two of said varnishing units being disposed for defining a nip between varnishing blanket cylinders thereof, and wherein sheets to be varnished on both sides are guided through said nip; and at least two IR or hot-air dryers, said dryers including at least one dryer disposed below the sheet travel path;

gripper bars disposed for conveying sheets to be varnished on both sides through the nip between said two varnishing blanket cylinders, said gripper bars being pairs of gripper bars carrying grippers for holding the sheets conveyed through said nip between said varnishing blanket cylinders at leading and trailing edges thereof.

19. A method of printing multiple colors on two sides of a sheet, which comprises the following method steps:

individually feeding sheets from a sheet pile through a plurality of in-line printing units and printing on a front side of the sheets;

subsequently turning the sheets and printing multiple colors on a back side of the sheets in a plurality of further in-line printing units;

applying one or more coats of varnish to the printed front side and back side of the sheets with identical-type varnishing units disposed above and below a sheet travel path, and the varnishing units each having a respective varnish blanket cylinder defining a nip therebetween;

transporting the sheets through the nip with gripper bars disposed on revolving chains;

drying the at least one front side and back side with one or more dryers disposed above and below the sheet travel path;

delivering the sheets, after drying, to a sheet pile or for further processing of the sheets.

20. The method according to claim 19, which comprises printing and varnishing sheets of paper.

21. The method according to claim 19, which comprises first drying a first sheet side that has been varnished before varnishing a second sheet side.

22. The method according to claim 19, which comprises drying both sides of the sheets after varnishing both sides.

23. A sheet-fed offset printing press for double-sided multi-color printing, comprising:

a first row of in-line printing units for printing on a first side of a sheet;

a downstream reversing device following said first row of in-line printing units in a sheet travel direction;

a second row of in-line printing units for printing a second side of the sheet disposed downstream of said reversing device, said second row of in-line printing units including a last printing unit;

downstream varnishing units including at least two varnishing units of a common type following said last printing unit and configured to varnish the first side and the second side of the sheet on passing by, said varnishing units each including a respective varnishing blanket cylinder disposed for respectively varnishing the first side and the second side of the passing sheet that are varnished, said varnishing units each including a respective transport cylinder, said respective blanket cylinder and said respective transport cylinder defining a nip therebetween, one of said varnishing blanket cylinders being disposed above the sheet travel path and another of said varnishing blanket cylinders being disposed below the sheet travel path; and precisely four sheet transport drums or transfer devices being disposed between said respective transport cylinders of successive said varnishing units.

24. A method of printing multiple colors on two sides of a sheet, which comprises the following method steps:

individually feeding sheets from a sheet pile through a plurality of in-line printing units and printing on a front side of the sheets;

subsequently turning the sheets and printing multiple colors on a back side of the sheets in a plurality of further in-line printing units;

applying one or more coats of varnish to the printed front side and back side of the sheets with identical-type varnishing units disposed above and below a sheet travel path, and the varnishing units each having a respective varnish blanket cylinder defining a nip therebetween;

transporting the sheets through the nip with gripper bars disposed on a multiple-diameter transport drum having a diameter being a multiple of a diameter of a form cylinder of the printing units;

drying the at least one front side and back side with one or more dryers disposed above and below the sheet travel path;

delivering the sheets, after drying, to a sheet pile or for further processing of the sheets.

* * * * *